US011094289B2

(12) United States Patent
Tanaka et al.

(10) Patent No.: US 11,094,289 B2
(45) Date of Patent: Aug. 17, 2021

(54) COLOR CORRECTION APPARATUS, DISPLAY APPARATUS, AND COLOR CORRECTION METHOD

(71) Applicant: Mitsubishi Electric Corporation, Tokyo (JP)

(72) Inventors: Shogo Tanaka, Kumamoto (JP); Kazuhiro Ishiguchi, Kumamoto (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/923,421

(22) Filed: Jul. 8, 2020

(65) Prior Publication Data

US 2021/0027744 A1 Jan. 28, 2021

(30) Foreign Application Priority Data

Jul. 22, 2019 (JP) ..... JP2019-134834

(51) Int. Cl.
*G09G 3/36* (2006.01)
*G09G 5/06* (2006.01)

(52) U.S. Cl.
CPC ..... *G09G 5/06* (2013.01); *G09G 3/3607* (2013.01); *G09G 2320/0242* (2013.01); *G09G 2320/0271* (2013.01); *G09G 2320/0666* (2013.01)

(58) Field of Classification Search
CPC ..... G09G 5/06; G09G 3/2003; G09G 3/2007; G09G 3/3648
See application file for complete search history.

(56) References Cited

U.S. PATENT DOCUMENTS

| | | | | |
|---|---|---|---|---|
| 5,987,168 | A | 11/1999 | Decker et al. | |
| 6,330,075 | B1 | 12/2001 | Ishikawa | |
| 7,333,136 | B2 | 2/2008 | Takemoto | |
| 7,590,299 | B2 | 9/2009 | Brown Elliott et al. | |
| 7,893,944 | B2 | 2/2011 | Higgins et al. | |
| 8,212,836 | B2 | 7/2012 | Matsumoto et al. | |
| 8,223,166 | B2 * | 7/2012 | Brown Elliott ..... | G09G 3/2055 345/596 |
| 8,229,212 | B2 | 7/2012 | Siddiqui et al. | |
| 8,295,594 | B2 | 10/2012 | Brown Elliott et al. | |
| 8,649,056 | B2 | 2/2014 | Kobayashi | |

(Continued)

FOREIGN PATENT DOCUMENTS

| | | |
|---|---|---|
| JP | H09-102886 A | 4/1997 |
| JP | H10-297026 A | 11/1998 |

(Continued)

*Primary Examiner* — Roy P Rabindranath
(74) *Attorney, Agent, or Firm* — Studebaker & Brackett PC

(57) ABSTRACT

An adjustment is performed on input gradation values, and 1st-stage gradation values are obtained. When a color expressed by a set of the input gradation values is a single color of any one of R, G, and B, the 1st-stage gradation value is set to 0. Further, correction is performed for R, G, and B according to one-dimensional lookup tables, respectively, and correction is performed for W according to one-dimensional lookup tables. Further, a contribution amount of the gradation values obtained through correction of the former and the gradation values obtained through correction of the latter to output gradation values is changed according to a color expressed by a set of the 1st-stage gradation values.

4 Claims, 4 Drawing Sheets

(56) References Cited

U.S. PATENT DOCUMENTS

| | | | | |
|---|---|---|---|---|
| 9,025,223 | B2 | 5/2015 | Murakami | |
| 9,430,986 | B2 | 8/2016 | Ito et al. | |
| 10,152,935 | B2 * | 12/2018 | Tanaka | G09G 3/3648 |
| 2017/0249888 | A1 | 8/2017 | Tanaka et al. | |

FOREIGN PATENT DOCUMENTS

| | | | |
|---|---|---|---|
| JP | H10-307911 | A | 11/1998 |
| JP | 2002-016939 | A | 1/2002 |
| JP | 2005-072850 | A | 3/2005 |
| JP | 2006-128815 | A | 5/2006 |
| JP | 2006-171049 | A | 6/2006 |
| JP | 2006-303785 | A | 11/2006 |
| JP | 2008-085731 | A | 4/2008 |
| JP | 2009-004862 | A | 1/2009 |
| JP | 2009-093182 | A | 4/2009 |
| JP | 2009-282977 | A | 12/2009 |
| JP | 2010-271367 | A | 12/2010 |
| JP | 2012-170017 | A | 9/2012 |
| JP | 2012-170018 | A | 9/2012 |
| JP | 2014-120796 | A | 6/2014 |
| JP | 2017-158170 | A | 9/2017 |
| WO | 2005/124663 | A2 | 12/2005 |
| WO | 2007/047537 | A2 | 4/2007 |
| WO | 2009/101802 | A1 | 8/2009 |
| WO | 2009/126540 | A1 | 10/2009 |
| WO | 2012/049845 | A1 | 4/2012 |

* cited by examiner

COLOR CORRECTION APPARATUS, DISPLAY APPARATUS, AND COLOR CORRECTION METHOD

BACKGROUND OF THE INVENTION

Field of the Invention

The present invention relates to a color correction apparatus, a display apparatus, and a color correction method.

Description of the Background Art

In liquid crystal display apparatuses, additive color mixing for generating various colors by mixing three primary colors such as red, green, and blue is performed. Thus, in liquid crystal display apparatuses, three gradation values representing primary color amounts of three primary colors are input, and colors according to the input three gradation value are displayed.

However, if colors displayed when all or a part of the input three gradation values is gradually changed do not change smoothly, observers who observe the display colors have an unnatural impression. This problem is particularly notable in gradation of white.

Thus, to achieve smooth change of colors displayed when all or a part of the three gradation values is gradually changed, correction of γ characteristics indicating a relationship between gradation values representing primary color amounts of input primary colors and brightness of primary color components of display colors is performed.

Correction of γ characteristics is in many cases performed according to lookup tables. A lookup table defines gradation conversion characteristics, and includes a plurality of input gradation values as an index and output gradation values associated with the plurality of respective input gradation values. When correction of γ characteristics is performed according to lookup tables, gradation conversion for gradation values before gradation conversion is performed according to the lookup tables. In gradation conversion, output gradation values associated with input gradation values matching the gradation values before gradation conversion are specified, and the specified output gradation values are used as gradation values after gradation conversion.

When one lookup table that is common to all of the three primary colors is provided and correction of γ characteristics is performed according to the provided one lookup table, gradation conversion is performed on each of the three gradation values before gradation conversion according to the one lookup table. In this case, a ratio of three gradation values after gradation conversion cannot be arranged to differ from a ratio of three gradation values before gradation conversion, and thus color correction cannot be performed.

To enable performance of color correction, providing three lookup tables for three respective primary colors and performing correction of γ characteristics according to the provided three lookup table has been proposed. In this case, a ratio of three gradation values after gradation conversion can be arranged to differ from a ratio of three gradation values before gradation conversion, and thus color correction for white can be performed. However, depending on characteristics of a liquid crystal display apparatus, color correction for a desired color may not be appropriately performed.

Further, to enable appropriate performance of color correction for a desired color regardless of characteristics of a liquid crystal display apparatus, providing lookup tables for three primary colors and a lookup table for white and performing color correction according to the provided lookup tables has been proposed. In this case, correction is performed for each of the three primary colors according to the one-dimensional lookup tables for the three primary colors, and correction is performed for white according to the one-dimensional lookup table for white. In addition, an amount of application of correction of the former and the latter is changed according to a color expressed by a set of gradation values before correction. Accordingly, correction of γ characteristics is appropriately performed for each of the three primary colors and white, and color correction for white is appropriately performed. In addition, color correction is appropriately performed for a desired color. Further, correction of γ characteristics and colors is performed according to the one-dimensional lookup tables, and thus correction of γ characteristics and colors according to characteristics of a liquid crystal display apparatus is performed with a small amount of resources. The technology described in Japanese Patent Application Laid-Open No. 2017-158170 is one example of such a technology.

Further, in recent years, to enhance utilization efficiency of light and extend a range of reproduction of colors, additive color mixing for generating various colors by mixing four colors consisting of three primary colors and an additional color other than the three primary colors may be performed in a liquid crystal display apparatus. At the same time, in general, a liquid crystal display apparatus receives input of three gradation values representing primary color amounts of three primary colors. Thus, when additive color mixing for generating various colors by mixing four colors is performed in a liquid crystal display apparatus, in general, input three gradation values representing primary color amounts of the three primary colors are converted into four gradation values consisting of three gradation values representing primary color amounts of the three primary colors and a gradation value representing a color amount of an additional color. However, depending on results of conversion from three gradation values to four gradation values, unnatural display, such as display of unnatural colors and generation of an unnatural luminance difference, may be caused. In view of this, a technology of converting three gradation values into four gradation values to enable enhancement of utilization efficiency of light and extension of a range of reproduction of colors and also enable reduction of occurrence of unnatural display has been studied. The technology described in Japanese Patent Application Laid-Open No. 2006-171049 is one example of such a technology.

A liquid crystal display apparatus that performs additive color mixing for generating various colors by mixing four colors consisting of three primary colors and an additional color has characteristics different from characteristics of a liquid crystal display apparatus that performs additive color mixing for generating various colors by mixing three primary colors. Further, in a liquid crystal display apparatus of the former, mixed colors include an additional color other than three primary colors, and thus it is difficult to appropriately perform color correction for some desired color. It is difficult to appropriately perform color correction for white in particular. For this reason, when white is displayed in a liquid crystal display apparatus of the former, unnatural display may be notably caused. Accordingly, high-accuracy color correction is required in a liquid crystal display apparatus of the former.

Such a problem can be addressed by performing color correction according to three-dimensional lookup tables or by performing color correction according to multiple one-dimensional lookup tables, for example.

At the same time, in a liquid crystal display apparatus, a frame image needs to be displayed immediately after a signal representing the frame image is input. Accordingly, processing of signals including color correction needs to be performed in real time. Thus, when color correction is performed according to three-dimensional lookup tables or multiple one-dimensional lookup tables, the three-dimensional lookup tables or the multiple one-dimensional lookup tables are desirably incorporated into hardware.

However, incorporating three-dimensional lookup tables or multiple one-dimensional lookup tables into hardware requires a large amount of resources. Thus, incorporating three-dimensional lookup tables or multiple one-dimensional lookup tables into hardware is unrealistic.

These problems occur also when color correction is performed in structures other than a liquid crystal display apparatus.

SUMMARY

The present invention is made to solve the problems described above. The problem to be solved by the present invention is to appropriately perform color correction according to characteristics of a display apparatus that performs additive color mixing for generating various colors by mixing four colors consisting of three primary colors and an additional color with a small amount of resources.

The present invention has an object to appropriately perform color correction according to characteristics of a display apparatus that performs additive color mixing for generating various colors by mixing four colors consisting of three primary colors and an additional color with a small amount of resources.

The present invention relates to a color correction apparatus and a color correction method. The color correction apparatus may be incorporated into a display apparatus.

An adjustment is performed on a first input gradation value, a second input gradation value, a third input gradation value, and a fourth input gradation value. A first 1st-stage gradation value, a second 1st-stage gradation value, a third 1st-stage gradation value, and a fourth 1st-stage gradation value are obtained. The fourth 1st-stage gradation value is set to 0 in the adjustment when a color expressed by a set of the first input gradation value, the second input gradation value, the third input gradation value, and the fourth input gradation value is a single color of any one of a first primary color, a second primary color, and a third primary color.

The first input gradation value, the second input gradation value, and the third input gradation value represent primary color amounts of the first primary color, the second primary color, and the third primary color, respectively. The fourth input gradation value represents a color amount of an additional color other than the first primary color, the second primary color, and the third primary color. The first 1st-stage gradation value, the second 1st-stage gradation value, and the third 1st-stage gradation value represent primary color amounts of the first primary color, the second primary color, and the third primary color, respectively. The fourth 1st-stage gradation value represents a color amount of the additional color.

A first one-dimensional lookup table, a second one-dimensional lookup table, and a third one-dimensional lookup table define gradation conversion characteristics related to the first primary color, the second primary color, and the third primary color, respectively.

Gradation conversion is performed on the first 1st-stage gradation value, the second 1st-stage gradation value, and the third 1st-stage gradation value according to the first one-dimensional lookup table, the second one-dimensional lookup table, and the third one-dimensional lookup table, respectively. A first 2nd-stage gradation value, a second 2nd-stage gradation value, and a third 2nd-stage gradation value are obtained.

The first 2nd-stage gradation value, the second 2nd-stage gradation value, and the third 2nd-stage gradation value represent primary color amounts the first primary color, the second primary color, and the third primary color, respectively.

A fourth one-dimensional lookup table, a fifth one-dimensional lookup table, and a sixth one-dimensional lookup table define gradation conversion characteristics related to white.

Gradation conversion is performed on the first 1st-stage gradation value, the second 1st-stage gradation value, and the third 1st-stage gradation value according to the fourth one-dimensional lookup table, the fifth one-dimensional lookup table, and the sixth one-dimensional lookup table, respectively. A fourth 2nd-stage gradation value, a fifth 2nd-stage gradation value, and a sixth 2nd-stage gradation value are obtained.

The fourth 2nd-stage gradation value, the fifth 2nd-stage gradation value, and the sixth 2nd-stage gradation value represent primary color amounts of the first primary color, the second primary color, and the third primary color, respectively.

A contribution amount of each of the first 2nd-stage gradation value and the fourth 2nd-stage gradation value to a first output gradation value is determined as a first contribution amount, a contribution amount of each of the second 2nd-stage gradation value and the fifth 2nd-stage gradation value to a second output gradation value is determined as a second contribution amount, and a contribution amount of each of the third 2nd-stage gradation value and the sixth 2nd-stage gradation value to a third output gradation value is determined as a third contribution amount, based on the first 1st-stage gradation value, the second 1st-stage gradation value, and third 1st-stage gradation value.

The first output gradation value, the second output gradation value, and the third gradation value represent primary color amounts of the first primary color, the second primary color, and the third primary color, respectively.

The first output gradation value is derived from the first 2nd-stage gradation value and the fourth 2nd-stage gradation value so that the contribution amount of each of the first 2nd-stage gradation value and the fourth 2nd-stage gradation value to the first output gradation value is the first contribution amount, the second output gradation value is derived from the second 2nd-stage gradation value and the fifth 2nd-stage gradation value so that the contribution amount of each of the second 2nd-stage gradation value and the fifth 2nd-stage gradation value to the second output gradation value is the second contribution amount, and the third output gradation value is derived from the third 2nd-stage gradation value and the sixth 2nd-stage gradation value so that the contribution amount of each of the third 2nd-stage gradation value and the sixth 2nd-stage gradation value to the third output gradation value is the third contribution amount.

According to the present invention, when a color expressed by four input gradation values consisting of three input gradation values representing primary color amounts of three primary colors and an input gradation value representing a color amount of an additional color other than the three primary colors is a single color of any one of the three primary colors, the gradation value representing the color amount of the additional color is set to 0, and correction for each of the three primary colors is performed without being affected by the additional color. Therefore, for each of the three primary colors, correction according to characteristics of a display apparatus that performs additive color mixing for generating various colors by mixing four colors consisting of three primary colors and an additional color can be appropriately performed.

Further, according to the present invention, correction is perfoiined for each of the three primary colors according to one-dimensional lookup tables, and correction for white is performed according to one-dimensional lookup tables. Further, an amount of application of correction of the former and the latter is changed according to a color expressed by a set of gradation values before correction. Accordingly, correction of γ characteristics is appropriately performed for each of the three primary colors and white, and color correction for white is appropriately performed. In addition, color correction is appropriately performed for a desired color.

Further, according to the present invention, correction of γ characteristics and colors is performed according to the one-dimensional lookup tables, and thus correction of γ characteristics and colors is performed with a small amount of resources.

These and other objects, features, aspects and advantages of the present disclosure will become more apparent from the following detailed description of the present disclosure when taken in conjunction with the accompanying drawings.

DESCRIPTION OF THE PREFERRED EMBODIMENTS

1. First Embodiment

1.1 Liquid Crystal Display Apparatus

Figure 1:
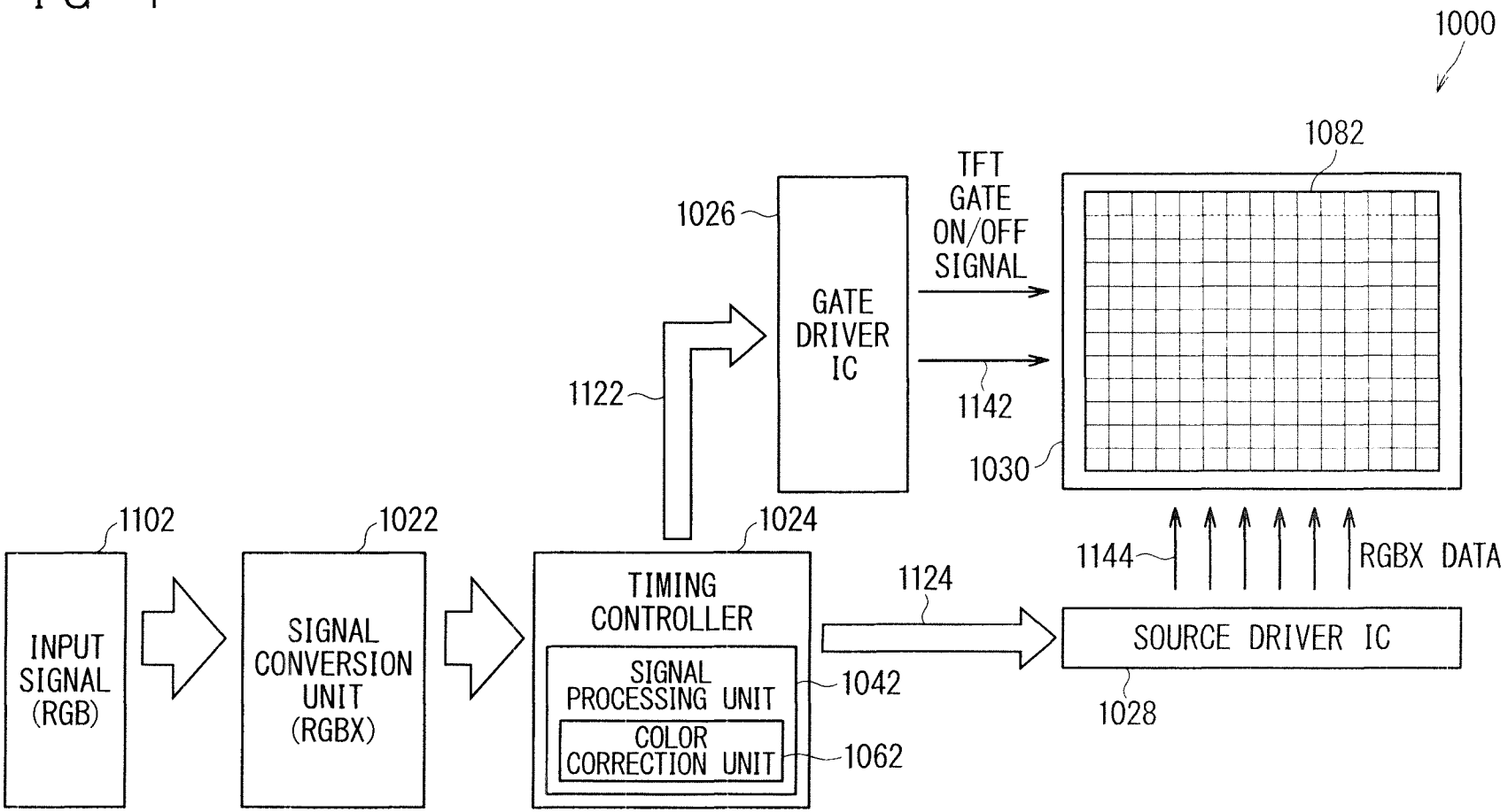
FIG. 1 is a block diagram illustrating a liquid crystal display apparatus according to the first embodiment.

FIG. 1 is a block diagram illustrating a liquid crystal display apparatus according to the first embodiment.

A liquid crystal display apparatus 1000 illustrated in FIG. 1 includes a signal conversion unit 1022, a timing controller 1024, a gate driver integrated circuit (IC) 1026, a source driver IC 1028, and a liquid crystal panel 1030. The timing controller 1024 includes a signal processing unit 1042. The signal processing unit 1042 includes a color correction unit 1062. The liquid crystal panel 1030 includes a plurality of pixels 1082. The liquid crystal display apparatus 1000 may include components other than the above components. Note that, in the following embodiment, white (W) is adopted as an additional color other than R, G, and B. However, to avoid misinterpretation with white used in a color correction apparatus to be described later, white (W) is represented as an additional color (X). Further, gradation values of the additional color (X) are represented as Xin, X'in, and Xout, for example.

An input signal 1102 includes a signal including image data. The image data includes three gradation values Rin, Gin, and Bin for each of the plurality of pixels 1082. The three gradation values Rin, Gin, and Bin represent primary color amounts of red (R), green (G), and blue (B) being three primary colors, respectively.

The input signal 1102 is a digital electric signal, is transmitted via a cable, and is input to the signal conversion unit 1022. The input signal 1102 may be replaced with a wirelessly transmitted input signal, and the liquid crystal display apparatus 1000 may include a receiver for receiving a wirelessly transmitted input signal. The input signal 1102 may be replaced with an input signal being an analog electric signal, and the liquid crystal display apparatus 1000 may include an A/D converter obtaining the gradation values Rin, Gin, and Bin by conversion of an input signal being an analog electric signal to a digital electric signal.

The signal conversion unit 1022 converts the three gradation values Rin, Gin, and Bin into four gradation values Rin, Gin, Bin, and Xin. The four gradation values Rin, Gin, Bin, and Xin are input to the timing controller 1024. The gradation values Rin, Gin, and Bin represent primary color amounts of R, G, and B, respectively. The gradation value Xin represents a color amount of the additional color (X) other than R, G, and B.

The signal processing unit 1042 outputs a signal 1122 used to control timing of driving each of the plurality of pixels 1082. An output signal 1122 is input to the gate driver IC 1026. Further, the signal processing unit 1042 processes an input signal including image data, outputs a signal 1124 used to control colors to be displayed in each of the plurality of pixels 1082. An output signal 1124 is input to the source driver IC 1028.

When the signal 1124 is generated, the color correction unit 1062 performs color correction. When color correction is performed, for each of the plurality of pixels 1082, the gradation values Rin, Gin, Bin, and Xin before correction are input to the color correction unit 1062, gradation values Rout, Gout, Bout, and Xout after correction are output from the color correction unit 1062.

The gate driver IC 1026 outputs an ON/OFF signal 1142 for controlling ON/OFF of thin film transistors (TFT) included in each of the plurality of pixels 1082 to TFT gates, based on the signal 1122.

The source driver IC 1028 outputs a color signal 1144 for controlling colors to be displayed in each of the plurality of pixels 1082 to TFT sources, based on the signal 1124. The color signal 1144 reflects the gradation values Rout, Gout, Bout, and Xout after correction that constitute RGBX data. (The gradation value Xout represents a gradation value Wout of white W.)

The gate driver IC 1026 and the source driver IC 1028 constitute a drive circuit for causing the pixels to display colors expressed by a set of gradation values Rout, Gout, Bout, and Xout after correction, for each of the plurality of pixels 1082. The drive circuit may be replaced with a drive circuit having a configuration different from the configuration of the above-described drive circuit.

The liquid crystal panel 1030 is a display panel. When colors expressed by a set of gradation values Rout, Gout, Bout, and Xout after correction are displayed in pixels for each of the plurality of pixels 1082, an image is displayed on the liquid crystal panel 1030.

1.2 Gradation Conversion

Figure 2:
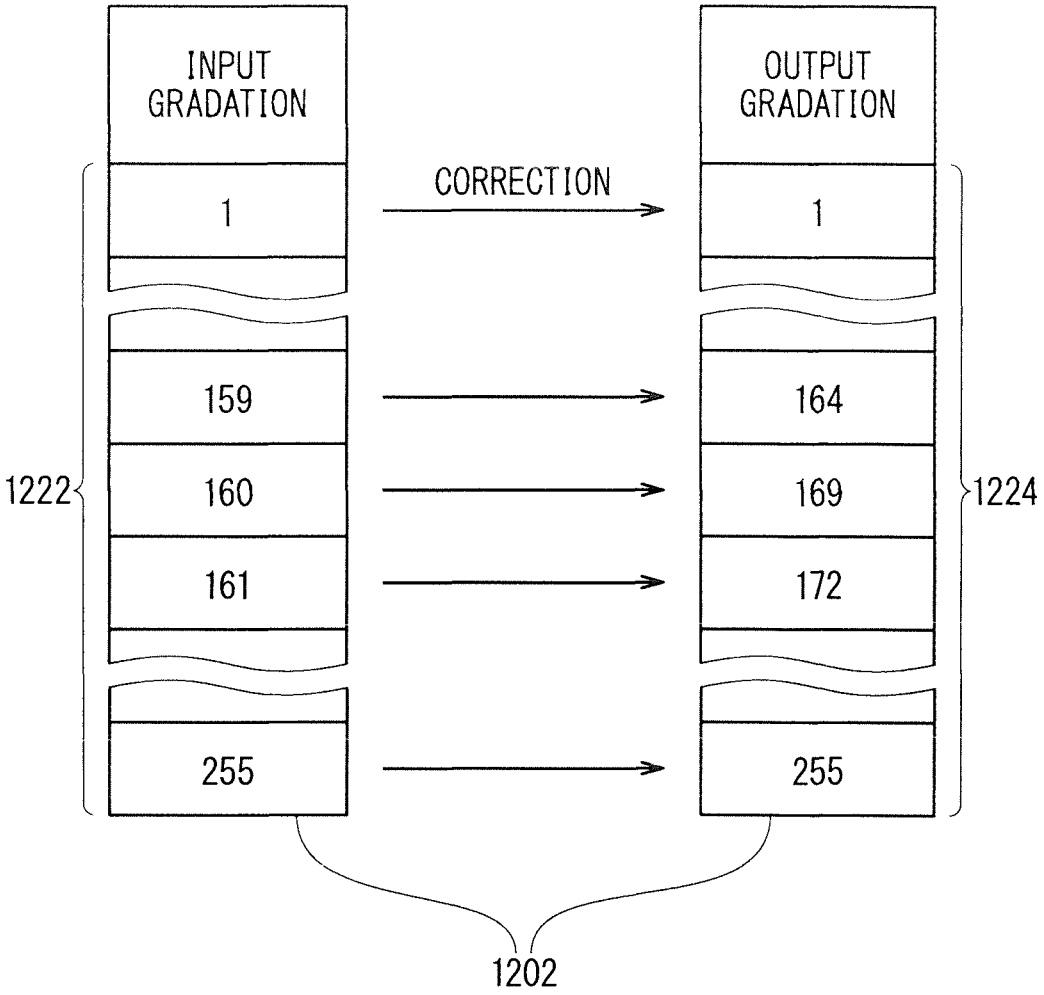
FIG. 2 is a diagram illustrating an example of gradation conversion according to the first embodiment.

FIG. 2 is a diagram illustrating an example of gradation conversion according to the first embodiment.

A one-dimensional lookup table 1202 illustrated in FIG. 2 defines gradation conversion characteristics of a case where gradation conversion from gradation values before gradation conversion to gradation values after gradation conversion is performed, includes 256 input gradation values 1222 of 1, . . . , 159, 160, 161, . . . , 255, and includes 256 output gradation values 1224 of 1, . . . , 164, 169, 172, . . . , 255 that are associated with respective 256 input gradation values. Each of the input gradation values 1222 is expressed by a bit stream of 8 bits. Each of the output gradation values 1224 is expressed by a bit stream of 8 bits. The 256 input gradation values 1222 may be replaced with a plurality of input gradation values that are each expressed by a bit stream of 7 bits or less or 9 bits or more. The 256 output gradation values 1224 may be replaced with a plurality of output gradation values that are each expressed by a bit stream of 7 bits or less or 9 bits or more.

When gradation conversion is performed according to the one-dimensional lookup table 1202, an input gradation value matching a gradation value before gradation conversion is selected from the 256 input gradation values 1222, and an output gradation value associated with the selected input gradation value is used as a gradation value after gradation conversion. In this manner, gradation values before gradation conversion are converted into gradation values after gradation conversion. For example, when a gradation value before gradation conversion is 159, 160, or 161, a gradation value after gradation conversion is 164, 169, or 172, respectively.

1.3 Color Correction Apparatus

Figure 3:
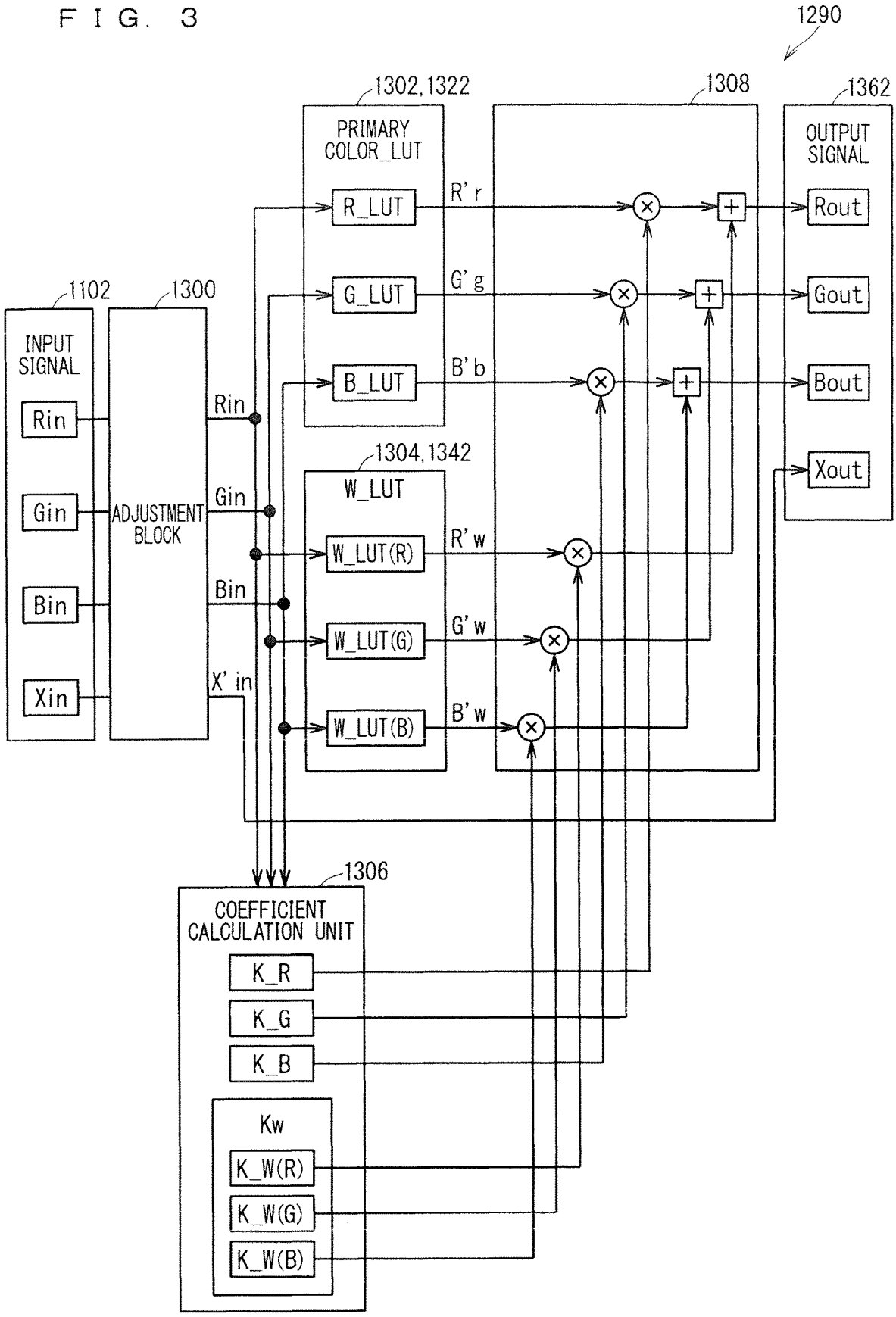
FIG. 3 is a block diagram illustrating a color correction apparatus according to the first embodiment.

FIG. 3 is a block diagram illustrating a color correction apparatus according to the first embodiment.

A color correction apparatus 1290 illustrated in FIG. 3 serves as the color correction unit 1062 when being incorporated into the liquid crystal display apparatus 1000, and includes an adjustment block 1300, a primary color correction unit 1302, a white correction unit 1304, a coefficient calculation unit 1306, and a gradation value calculation unit 1308. The primary color correction unit 1302 includes a primary color gradation conversion unit 1322. The white correction unit 1304 includes a white gradation conversion unit 1342. The color correction apparatus 1290 may include components other than the above components.

The color correction apparatus 1290 may be incorporated into a liquid crystal display apparatus having a configuration different from the configuration of the liquid crystal display apparatus 1000, a display apparatus other than a liquid crystal display apparatus, or an apparatus other than a display apparatus, for example.

The input signal 1102 includes input gradation values Rin, Gin, and Bin representing primary color amounts of R, G, and B, respectively, and includes an input gradation value Xin representing a color amount of X. The input gradation values Rin, Gin, Bin, and Xin are gradation values before correction, and are input to the adjustment block 1300. R, G, and B may be replaced with three primary colors other than R, G, and B.

The adjustment block 1300 performs an adjustment on the input gradation values Rin, Gin, Bin, and Xin, and outputs 1st-stage gradation values Rin, Gin, Bin, and X'in. The 1st-stage gradation values Rin, Gin, and Bin represent primary color amounts of R, G, and B, respectively. The 1st-stage gradation value X'in represents a color amount of X. When a color expressed by a set of the input gradation values Rin, Gin, Bin, and Xin is a single color of any one of R, G, and B, the adjustment block 1300 sets the 1st-stage gradation value X'in to 0 in the adjustment. In this manner, a single color of any one of R, G, and B can be displayed without causing deterioration in chroma of the single color of any one of R, G, and B. Further, for each of R, G, and B, correction according to characteristics of the liquid crystal display apparatus 1000 of four-color configuration that performs additive color mixing for generating various colors by mixing four colors consisting of R, G, B, and X can be appropriately performed. The 1st-stage gradation values Rin, Gin, Bin, and X'in are input to each of the primary color correction unit 1302, the white correction unit 1304, and the coefficient calculation unit 1306.

The primary color gradation conversion unit 1322 stores primary color one-dimensional lookup tables R_LUT, G_LUT, and B_LUT that respectively define gradation conversion characteristics related to R, G, and B, which are an aggregation of one-dimensional lookup tables for performing correction of the 1st-stage gradation values Rin, Gin, and Bin. The primary color one-dimensional lookup tables R_LUT, G_LUT, and B_LUT are provided for correcting γ characteristics of R, G, and B, respectively, and are desirably implemented in hardware.

The primary color gradation conversion unit 1322 obtains a gradation value R'r after gradation conversion by performing gradation conversion on the 1st-stage gradation value Rin according to the one-dimensional lookup table R_LUT, obtains a gradation value G'g after gradation conversion by performing gradation conversion on the 1st-stage gradation value Gin according to the one-dimensional lookup table G_LUT, and obtains a gradation value B'b after gradation conversion by performing gradation conversion on the 1st-stage gradation value Bin according to the one-dimensional lookup table B_LUT. The gradation values R'r, G'g, and B'b after gradation conversion output from the primary color gradation conversion unit 1322 are directly used as 2nd-stage gradation values R'r, G'g, and B'b to be output from the primary color correction unit 1302. In this manner, the primary color correction unit 1302 obtains the 2nd-stage gradation values R'r, G'g, and B'b. The 2nd-stage gradation values R'r, G'g, and B'b represent primary color amounts of R, G, and B, respectively.

The white gradation conversion unit 1342 stores one-dimensional lookup tables W_LUT(R), W_LUT(G), and W_LUT(B) that define gradation conversion characteristics related to white (W), which are an aggregation of one-dimensional lookup tables for performing correction of the 1st-stage gradation values Rin, Gin, and Bin. W is a mixed color of R, G, and B, and therefore the gradation conversion characteristics related to W are defined by a set of the one-dimensional lookup tables W_LUT(R), W_LUT(G), and W_LUT(B) that respectively define gradation conversion characteristics related to R, G, and B. The one-dimensional lookup tables W_LUT(R), W_LUT(G), and W_LUT (B) are provided for correcting γ characteristics and color of W, and are desirably implemented in hardware.

The white gradation conversion unit 1342 obtains a gradation value R'w after gradation conversion by performing gradation conversion on the 1st-stage gradation value Rin according to the one-dimensional lookup table W_LUT (R), obtains a gradation value G'w after gradation conversion by performing gradation conversion on the 1st-stage gradation value Gin according to the one-dimensional lookup table W_LUT(G), and obtains a gradation value B'w after gradation conversion by performing gradation conversion on the 1st-stage gradation value Bin according to the one-dimensional lookup table W_LUT(B). The gradation values R'w, G'w, and B'w after gradation conversion output from the white gradation conversion unit 1342 are directly used as 2nd-stage gradation values R'w, G'w, and B'w to be output from the white correction unit 1304. In this manner, the white correction unit 1304 obtains the 2nd-stage gradation values R'w, G'w, and B'w. The 2nd-stage gradation values R'w, G'w, and B'w represent primary color amounts of R, G, and B, respectively.

The coefficient calculation unit 1306 calculates weight coefficients K_R, K_G, K_B, K_W(R), K_W(G), and K_W(B), based on the 1st-stage gradation values Rin, Gin, and Bin. The weight coefficients K_R, K_G, K_B, K_W(R), K_W(G), and K_W(B) correspond to the one-dimensional lookup tables R_LUT, G_LUT, B_LUT, W_LUT(R), W_LUT(G), and W_LUT(B), respectively. Each of the weight coefficients K_R, K_G, K_B, K_W(R), K_W(G), and K_W(B) represents a weight of a gradation value after gradation conversion obtained through gradation conversion that is performed according to a corresponding one-dimensional lookup table. Thus, the weight coefficients K_R, K_G, K_B, K_W(R), K_W(G), and K_W(B) represent a weight of the 2nd-stage gradation values R'r, G'g, B'b, R'w, G'w, and B'w, respectively.

The gradation value calculation unit 1308 converts a weighted sum K_R*R'r+K_W(R)*R'w in which the weight coefficients K_R and K_W(R) are respectively multiplied by the 2nd-stage gradation values R'r and R'w into an output gradation value Rout, converts a weighted sum K_G*G'g+K_W(G)*G'w in which the weight coefficients K_G and K_W(G) are respectively multiplied by the 2nd-stage gradation values G'g and G'w into an output gradation value Gout, and converts a weighted sum K_B*B'b+K_W(B)*B'w in which the weight coefficients K_B and K_W(B) are respectively multiplied by the 2nd-stage gradation values B'b and B'w into an output gradation value Bout. The output gradation values Rout, Gout, and Bout included in the output signal 1362 are gradation values after correction, and represent primary color amounts of R, G, and B, respectively.

The amount of contribution of the 2nd-stage gradation value R'r to the output gradation value Rout is smaller as the weight coefficient K_R is smaller. The amount of contribution of the 2nd-stage gradation value R'r to the output gradation value Rout is larger as the weight coefficient K_R is larger. The amount of contribution of the 2nd-stage gradation value R'w to the output gradation value Rout is smaller as the weight coefficient K_W(R) is smaller. The amount of contribution of the 2nd-stage gradation value R'w to the output gradation value Rout is larger as the weight coefficient K_W(R) is larger. Accordingly, the weight coefficients K_R and K_W(R) express a contribution amount of the 2nd-stage gradation values R'r and R'w to the output gradation value Rout, respectively.

In a similar manner, the weight coefficients K_G and K_W(G) express a contribution amount of the 2nd-stage gradation values G'g and G'w to the output gradation value Gout, respectively, and the weight coefficients K_B and K_W(B) express a contribution amount of the 2nd-stage gradation values B'b and B'w to the output gradation value Bout, respectively.

Thus, the coefficient calculation unit 1306 constitutes a determination unit that determines the contribution amount of each of the 2nd-stage gradation values R'r and R'w to the output gradation value Rout as an amount expressed by the weight coefficients K_R and K_W(R), determines the contribution amount of each of the 2nd-stage gradation values G'g and G'w to the output gradation value Gout as an amount expressed by the weight coefficients K_G and K_W(G), and determines the contribution amount of each of the 2nd-stage gradation values B'b and B'w to the output gradation value Bout as an amount expressed by the weight coefficients K_B and K_W(B).

Further, the gradation value calculation unit 1308 constitutes a derivation unit that derives the output gradation value Rout from the 2nd-stage gradation values R'r and R'w so that the contribution amount of each of the 2nd-stage gradation values R'r and R'w to the output gradation value Rout is expressed by the weight coefficients K_R and K_W(R), derives the output gradation value Gout from the 2nd-stage gradation values G'g and G'w so that the contribution amount of each of the 2nd-stage gradation values G'g and G'w to the output gradation value Gout is expressed by the weight coefficients K_G and K_W(G), and derives the output gradation value Bout from the 2nd-stage gradation values B'b and B'w so that the contribution amount of each of the 2nd-stage gradation values B'b and B'w to the output gradation value Bout is expressed by the weight coefficients K_B and K_W(B).

When the weight coefficients K_R, K_G, K_B, K_W(R), K_W(G), and K_W(B) are calculated, an index Kw representing proximity of the color expressed by a set of the 1st-stage gradation values Rin, Gin, and Bin to W is calculated according to formula (1).

$$Kw=1-(\mathrm{RGBin_MAX}-\mathrm{RGBin_MIN})/\mathrm{RGBin_MAX} \quad (1)$$

The maximum value RGBin_MAX is a maximum value among the 1st-stage gradation values Rin, Gin, and Bin, and is calculated according to formula (2).

$$\mathrm{RGBin_MAX}=\mathrm{MAX}(Rin,Gin,Bin) \quad (2)$$

The minimum value RGBin_MIN is a minimum value among the 1st-stage gradation values Rin, Gin, and Bin, and is calculated according to formula (3).

$$\mathrm{RGBin_MIN}=\mathrm{MIN}(Rin,Gin,Bin) \quad (3)$$

The index Kw indicates 1 when the color expressed by a set of the 1st-stage gradation values Rin, Gin, and Bin is W, because Rin=Gin=Bin. The index Kw indicates 0 when the color is R, G, or B, because two of the 1st-stage gradation values Rin, Gin, and Bin indicate 0. The index Kw becomes larger as the color is closer to white. Accordingly, the index Kw is a factor representing a weight of W, and an index 1−Kw, which is obtained by subtracting the index Kw from 1, is a factor representing a total weight of the weight of R, the weight of G, and the weight of B.

Further, an index Kr representing proximity of the color expressed by the 1st-stage gradation values Rin, Gin, and Bin to R is calculated according to formula (4), an index Kg representing proximity of the color to G is calculated according to formula (5), and an index Kb representing proximity of the color to B is calculated according to formula (6).

$$Kr=(1-Kw)*Rin/(Rin+Gin+Bin) \quad (4)$$

$$Kg=(1-Kw)*Gin/(Rin+Gin+Bin) \quad (5)$$

$$Kb=(1-Kw)*Bin/(Rin+Gin+Bin) \quad (6)$$

The index 1−Kw is a factor representing a total weight of the weight of R, the weight of G, and the weight of B, and a ratio like Rin/(Rin+Gin+Bin), Gin/(Rin+Gin+Bin), and Bin/(Rin+Gin+Bin) represents a ratio of the weight of R, the weight of G, and the weight of B. Thus, according to formulas (4), (5), and (6), a total of the weight of R, the weight of G, and the weight of B is distributed to each primary color of R, G, and B according to the weight of each primary color.

Further, weight coefficients K_W(R), K_W(G), K_W(B), K_R, K_G, and K_B are calculated according to formulas (7), (8), (9), (10), (11), and (12), respectively.

$$K_W(R)=Kw/(Kr+Kw) \quad (7)$$

$$K_W(G)=Kw/(Kg+Kw) \quad (8)$$

$$K_W(B)=Kw/(Kb+Kw) \quad (9)$$

$$K_R=1-K_W(R) \quad (10)$$

$$K_G=1-K_W(G) \quad (11)$$

$$K_B=1-K_W(B) \quad (12)$$

The index Kr is a factor representing a weight of R, and the index Kw is a factor representing a weight of W. Thus, the weight coefficient K_W(R) being a ratio of the index Kw in the sum of the indices Kr and Kw specifies a ratio to which correction for W that is the most affected by the characteristics of the liquid crystal display apparatus 1000 is to be applied. In a similar manner, each of the weight coefficients K_W(G) and K_W(B) specifies a ratio to which correction for W that is the most affected by the characteristics of the liquid crystal display apparatus 1000 is to be applied.

Formulas (1) to (12) are merely examples, and the weight coefficients K_W(R), K_W(G), K_W(B), K_R, K_G, and K_B may be calculated according to formulas different from formulas (1) to (12).

Each of the weight coefficients K_W(R), K_W(G), K_W(B), K_R, K_G, and K_B indicates a value of 0 or greater and 1 or less. Further, the sum of the weight coefficient K_R and the weight coefficient K_W(R) is 1, the sum of the weight coefficient K_G and the weight coefficient K_W(G) is 1, and the sum of the weight coefficient K_B and the weight coefficient K_W(B) is 1. In this manner, the output gradation values Rout, Gout, and Bout can be obtained with simple weighted sums.

According to the weight coefficients K_W(R), K_W(G), K_W(B), K_R, K_G, and K_B, as the color expressed by a set of the 1st-stage gradation values Rin, Gin, and Bin is closer to white and as the index Kw is larger, contribution of the 2nd-stage gradation value R'r to the output gradation value Rout is smaller, contribution of the 2nd-stage gradation value R'w to the output gradation value Rout is larger, contribution of the 2nd-stage gradation value G'g to the output gradation value Gout is smaller, contribution of the 2nd-stage gradation value G'w to the output gradation value Gout is larger, contribution of the 2nd-stage gradation value B'b to the output gradation value Bout is smaller, and contribution of the 2nd-stage gradation value B'w to the output gradation value Bout is larger.

When the calculation formulas for deriving the output gradation values Rout, Gout, and Bout are replaced with other calculation formulas, the coefficient representing the contribution amount of each of the 2nd-stage gradation values R'r and R'w to the output gradation value Rout, the coefficient representing the contribution amount of each of the 2nd-stage gradation values G'g and G'w to the output gradation value Gout, and the coefficient representing the contribution amount of each of the 2nd-stage gradation values B'b and B'w to the output gradation value Bout are replaced with coefficients according to such other calculation formulas.

The output gradation value Xout is obtained based on the 1st-stage gradation value X'in. In the first embodiment, the 1st-stage gradation value X'in is not corrected, and is directly used as the output gradation value Xout.

According to the first embodiment, when the color expressed by a set of the four input gradation values Rin, Gin, Bin, and Xin is a single color of any one of R, G, and B, the gradation value X'in representing the color amount of X is set to 0, so that correction for each of R, G, and B is performed without being affected by the additional color. Further, for each of R, G, and B, correction according to characteristics of the liquid crystal display apparatus 1000 that performs additive color mixing for generating various colors by mixing four colors consisting of R, G, B, and X can be appropriately performed. For example, color correction of correcting a display color to a color close to a desired color can be performed.

According to the first embodiment, correction of γ characteristics is performed for R, G, and B according to the one-dimensional lookup tables R_LUT, G_LUT, and B_LUT, respectively, and correction of γ characteristics and color is performed for W according to the one-dimensional lookup tables W_LUT(R), W_LUT(G), and W_LUT(B). Further, the contribution amount of each of the gradation values R'r, G'g, and B'b obtained through correction of the former and the gradation values R'w, G'w, and B'w obtained through correction of the latter to the gradation values Rout, Gout, and Bout after correction is changed according to a color expressed by a set of the gradation values Rin, Gin, and Bin before correction. Thus, correction of γ characteristics is appropriately performed for each of R, G, B, and W, and correction of the color of W is appropriately performed. In addition, color correction is appropriately performed for a desired color. Therefore, in the liquid crystal display apparatus 1000 incorporating the color correction apparatus 1290, color correction according to characteristics of the liquid crystal panel 1030 is performed for a desired color.

Further, according to the first embodiment, correction of γ characteristics and colors is performed according to the one-dimensional lookup tables R_LUT, B_LUT, W_LUT(R), W_LUT(G), and W_LUT(B), and thus correction of γ characteristics and colors is performed with a small amount of resources.

2. Second Embodiment

The second embodiment concerns a color correction apparatus that is configured by replacing the color correction apparatus according to the first embodiment.

In the color correction apparatus according to the first embodiment, when the output gradation value Xout is obtained based on the 1st-stage gradation value X'in, the 1st-stage gradation value X'in is not corrected and is directly used as the output gradation value Xout. In the color correction apparatus according to the second embodiment, by contrast, when the output gradation value Xout is obtained based on the 1st-stage gradation value X'in, the 1st-stage gradation value X'in is corrected and the corrected value is used as the output gradation value Xout.

Figure 4:
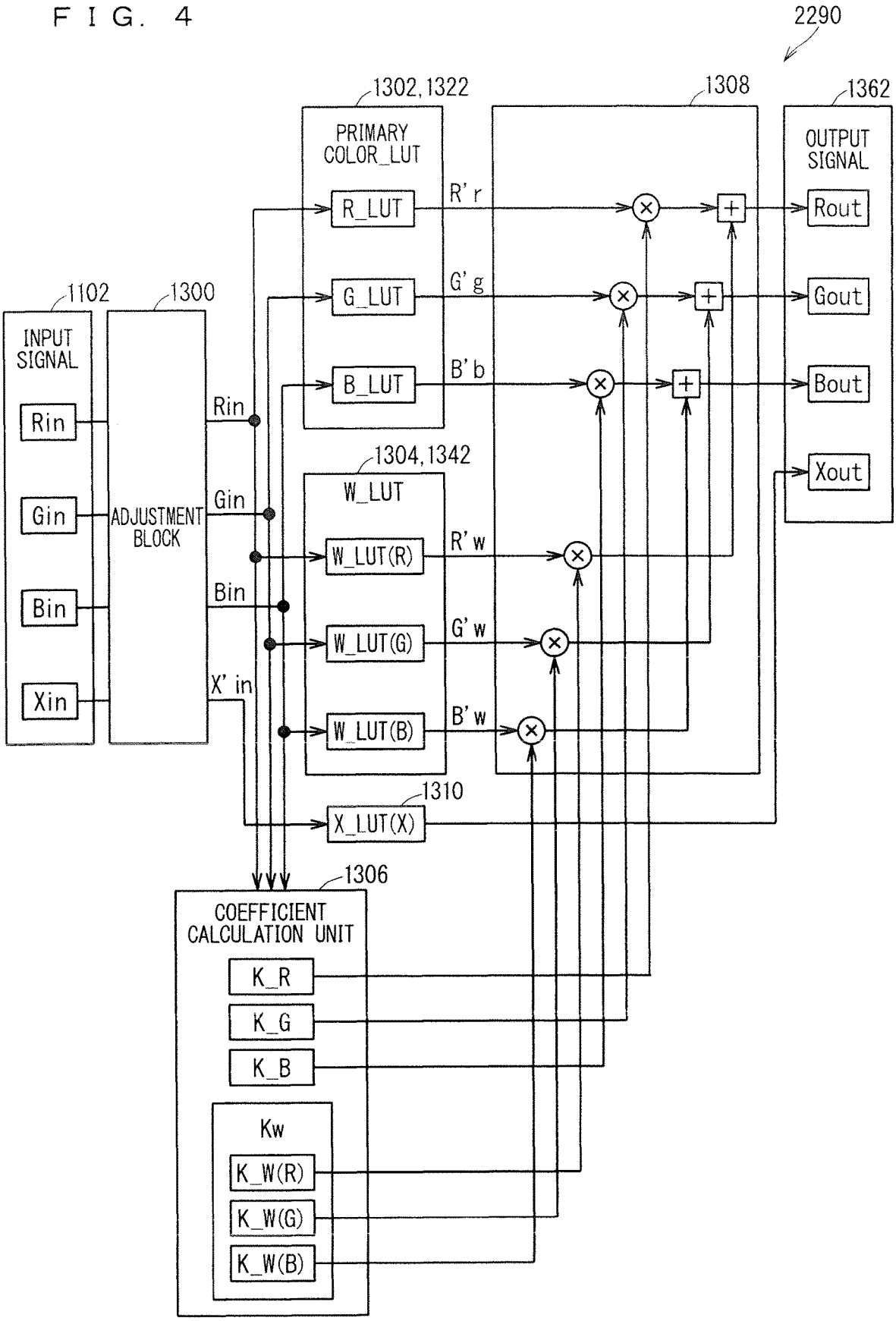
FIG. 4 is a block diagram illustrating a color correction apparatus according to the second embodiment.

FIG. 4 is a block diagram illustrating the color correction apparatus according to the second embodiment.

A color correction apparatus 2290 according to the second embodiment illustrated in FIG. 4 includes an adjustment block 1300, a primary color correction unit 1302, a white correction unit 1304, a coefficient calculation unit 1306, and a gradation value calculation unit 1308, as with the color correction apparatus 1290 according to the first embodiment illustrated in FIG. 3. The color correction apparatus 2290, however, further includes a gradation conversion unit 1310, unlike the color correction apparatus 1290.

The gradation conversion unit 1310 stores a one-dimensional lookup table X_LUT(X) that defines gradation conversion characteristics related to W, which is a one-dimensional lookup table for performing correction of the 1st-stage gradation value X'in. The one-dimensional lookup table X_LUT(X) is provided for correcting γ characteristics of W, and is desirably implemented in hardware.

The gradation conversion unit 1310 obtains a gradation value after gradation conversion by performing gradation conversion on the 1st-stage gradation value X'in according to the one-dimensional lookup table X_LUT(X). The gradation value after gradation conversion output from the gradation conversion unit 1310 is directly used as the output gradation value Xout.

According to the second embodiment, similarly to the first embodiment, for each of R, G, and B, correction according to characteristics of the liquid crystal display apparatus 1000 that performs additive color mixing for generating various colors by mixing four colors consisting of R, G, B, and X can be appropriately performed. For example, color correction of correcting a display color to a color close to a desired color can be performed.

Further, according to the second embodiment, similarly to the first embodiment, correction of γ characteristics is appropriately performed for each of R, G, B, and W, color correction is appropriately performed for W and color correction is appropriately performed for a desired color. Therefore, when the color correction apparatus 2290 is incorporated into the liquid crystal display apparatus 1000 instead of the color correction apparatus 1290, color correction according to characteristics of the liquid crystal panel 1030 is performed for a desired color.

Further, according to the second embodiment, similarly to the first embodiment, correction of γ characteristics and colors is performed with a small amount of resources.

In addition, according to the second embodiment, gradation conversion for the 1st-stage gradation value X'in is performed, and thus correction according to characteristics of the liquid crystal display apparatus 1000 can be further appropriately performed. Further, utilization efficiency of light can be enhanced and a range of reproduction of colors can be extended.

Note that, in the present invention, each embodiment can be freely combined and each embodiment can be modified or omitted as appropriate within the scope of the invention. For example, in the description of the first and second embodiments described above, white (W) is adopted as an additional color. However, yellow (Y) may be adopted instead of white (W), for example. In this case, in the plurality of pixels constituting a display panel, a color expressed by a set of gradation values Rout, Gout, and Bout and a yellow gradation value Yout is displayed in the pixels. In addition, as a matter of course, cyan or magenta may be adopted as an additional color.

In the first and second embodiments, embodiments are described by taking a liquid crystal display apparatus as an example of a display apparatus including a color correction apparatus. However, color correction described above is not necessarily performed in a specific display apparatus, and may be performed in various display apparatuses such as an organic electroluminescent (EL) display apparatus and a display using micro electro mechanical systems (MEMS).

While the disclosure has been shown and described in detail, the foregoing description is in all aspects illustrative and not restrictive. It is therefore understood that numerous modifications and variations can be devised.

What is claimed is:

1. A color correction apparatus comprising:

an adjustment block being configured to perform an adjustment on a first input gradation value representing a primary color amount of a first primary color, a second input gradation value representing a primary color amount of a second primary color, a third input gradation value representing a primary color amount of a third primary color, and a fourth input gradation value representing a color amount of an additional color other than the first primary color, the second primary color, and the third primary color, obtain a first 1st-stage gradation value representing a primary color amount of the first primary color, a second 1st-stage gradation value representing a primary color amount of the second primary color, a third 1st-stage gradation value representing a primary color amount of the third primary color, and a fourth 1st-stage gradation value representing a color amount of the additional color, and set the fourth 1st-stage gradation value to 0 in the adjustment when a color expressed by a set of the first input gradation value, the second input gradation value, the third input gradation value, and the fourth input gradation value is a single color of any one of the first primary color, the second primary color, and the third primary color;

a first correction unit being configured to store a first one-dimensional lookup table, a second one-dimensional lookup table, and a third one-dimensional lookup table respectively defining gradation conversion characteristics related to the first primary color, the second primary color, and the third primary color, perform gradation conversion on the first 1st-stage gradation value according to the first one-dimensional lookup table, perform gradation conversion on the second 1st-stage gradation value according to the second one-dimensional lookup table, and perform gradation conversion on the third 1st-stage gradation value according to the third one-dimensional lookup table, and obtain a first 2nd-stage gradation value representing a primary color amount of the first primary color, a second 2nd-stage gradation value representing a primary color amount of the second primary color, and a third 2nd-stage gradation value representing a primary color amount of the third primary color;

a second correction unit being configured to store a fourth one-dimensional lookup table, a fifth one-dimensional lookup table, and a sixth one-dimensional lookup table defining gradation conversion characteristics related to white, perform gradation conversion on the first 1st-stage gradation value according to the fourth one-dimensional lookup table, perform gradation conversion on the second 1st-stage gradation value according to the fifth one-dimensional lookup table, and perform gradation conversion on the third 1st-stage gradation value according to the sixth one-dimensional lookup table, and obtain a fourth 2nd-stage gradation value representing a primary color amount of the first primary color, a fifth 2nd-stage gradation value representing a primary color amount of the second primary color, and a sixth 2nd-stage gradation value representing a primary color amount of the third primary color;

a determination unit being configured to determine a contribution amount of each of the first 2nd-stage gradation value and the fourth 2nd-stage gradation value to a first output gradation value representing a primary color amount of the first primary color as a first contribution amount, determine a contribution amount of each of the second 2nd-stage gradation value and the fifth 2nd-stage gradation value to a second output gradation value representing a primary color amount of the second primary color as a second contribution amount, and determine a contribution amount of each of the third 2nd-stage gradation value and the sixth 2nd-stage gradation value to a third output gradation value representing a primary color amount of the third primary color as a third contribution amount, based on the first 1st-stage gradation value, the second 1st-stage gradation value, and the third 1st-stage gradation value; and a derivation unit being configured to derive the first output gradation value from the first 2nd-stage gradation value and the fourth 2nd-stage gradation value so that the contribution amount of each of the first 2nd-stage gradation value and the fourth 2nd-stage gradation value to the first output gradation value is the first contribution amount, derive the second output gradation value from the second 2nd-stage gradation value and the fifth 2nd-stage gradation value so that the contribution amount of each of the second 2nd-stage gradation value and the fifth 2nd-stage gradation value to the second output gradation value is the second contribution amount, and derive the third output gradation value from the third 2nd-stage gradation value and the sixth 2nd-stage gradation value so that the contribution amount of each of the third 2nd-stage gradation value and the sixth 2nd-stage gradation value to the third output gradation value is the third contribution amount.

2. The color correction apparatus according to claim 1 further comprising a gradation conversion unit being configured to store a seventh one-dimensional lookup table defining gradation conversion characteristics related to the additional color, perform gradation conversion on the fourth 1st-stage gradation value according to the seventh one-dimensional lookup table, and obtain a fourth output gradation value representing a color amount of the additional color.

3. A display apparatus comprising:

a display panel including a plurality of pixels;

the color correction apparatus according to claim 1, the color correction unit being configured to receive input of the first input gradation value, the second input gradation value, the third input gradation value, and the fourth input gradation value, and output the first output gradation value, the second output gradation value, the third output gradation value, and a fourth output gradation value which is obtained based on the fourth 1st-stage gradation value, for each of the plurality of pixels; and a drive circuit being configured to cause the plurality of pixels to display a color expressed by a set of the first output gradation value, the second output gradation value, the third output gradation value, and the fourth output gradation value, for each of the plurality of pixels.

4. A color correction method comprising the steps of:

a) performing an adjustment on a first input gradation value representing a primary color amount of a first primary color, a second input gradation value representing a primary color amount of a second primary color, a third input gradation value representing a primary color amount of a third primary color, and a fourth input gradation value representing a color amount of an additional color other than the first primary color, the second primary color, and the third primary color, obtaining a first 1st-stage gradation value representing a primary color amount of the first primary color, a second 1st-stage gradation value representing a primary color amount of the second primary color, a third 1st-stage gradation value representing a primary color amount of the third primary color, and a fourth 1st-stage gradation value representing a color amount of the additional color, and setting the fourth 1st-stage gradation value to 0 in the adjustment when a color expressed by a set of the first input gradation value, the second input gradation value, the third input gradation value, and the fourth input gradation value is a single color of any one of the first primary color, the second primary color, and the third primary color;

b) providing a first one-dimensional lookup table, a second one-dimensional lookup table, and a third one-dimensional lookup table respectively defining gradation conversion characteristics of the first primary color, the second primary color, and the third primary color, performing gradation conversion on the first 1st-stage gradation value according to the first one-dimensional lookup table, performing gradation conversion on the second 1st-stage gradation value according to the second one-dimensional lookup table, and performing gradation conversion on the third 1st-stage gradation value according to the third one-dimensional lookup table, and obtaining a first 2nd-stage gradation value representing a primary color amount of the first primary color, a second 2nd-stage gradation value representing a primary color amount of the second primary color, and a third 2nd-stage gradation value representing a primary color amount of the third primary color;

c) providing a fourth one-dimensional lookup table, a fifth one-dimensional lookup table, and a sixth one-dimensional lookup table defining gradation conversion characteristics of white, performing gradation conversion on the first 1st-stage gradation value according to the fourth one-dimensional lookup table, performing gradation conversion on the second 1st-stage gradation value according to the fifth one-dimensional lookup table, and performing gradation conversion on the third 1st-stage gradation value according to the sixth one-dimensional lookup table, and obtaining a fourth 2nd-stage gradation value representing a primary color amount of the first primary color, a fifth 2nd-stage gradation value representing a primary color amount of the second primary color, and a sixth 2nd-stage gradation value representing a primary color amount of the third primary color;

d) determining a contribution amount of each of the first 2nd-stage gradation value and the fourth 2nd-stage gradation value to a first output gradation value representing a primary color amount of the first primary color as a first contribution amount, determining a contribution amount of each of the second 2nd-stage gradation value and the fifth 2nd-stage gradation value to a second output gradation value representing a primary color amount of the second primary color as a second contribution amount, and determining a contribution amount of each of the third 2nd-stage gradation value and the sixth 2nd-stage gradation value to a third output gradation value representing a primary color amount of the third primary color as a third contribution amount, based on the first 1st-stage gradation value, the second 1st-stage gradation value, and the third 1st-stage gradation value; and e) deriving the first output gradation value from the first 2nd-stage gradation value and the fourth 2nd-stage gradation value so that the contribution amount of each of the first 2nd-stage gradation value and the fourth 2nd-stage gradation value to the first output gradation value is the first contribution amount, deriving the second output gradation value from the second 2nd-stage gradation value and the fifth 2nd-stage gradation value so that the contribution amount of each of the second 2nd-stage gradation value and the fifth 2nd-stage gradation value to the second output gradation value is the second contribution amount, and deriving the third output gradation value from the third 2nd-stage gradation value and the sixth 2nd-stage gradation value so that the contribution amount of each of the third 2nd-stage gradation value and the sixth 2nd-stage gradation value to the third output gradation value is the third contribution amount.

* * * * *